US011170589B2

(12) United States Patent
Hunt

(10) Patent No.: US 11,170,589 B2
(45) Date of Patent: Nov. 9, 2021

(54) EMERGENCY EVENT BASED VEHICLE DATA LOGGING

(71) Applicant: ZONAR SYSTEMS, INC., Seattle, WA (US)

(72) Inventor: Bryan Hunt, Seattle, WA (US)

(73) Assignee: Zonar Systems, Inc., Seattle, WA (US)

( * ) Notice: Subject to any disclaimer, the term of this patent is extended or adjusted under 35 U.S.C. 154(b) by 286 days.

(21) Appl. No.: 15/679,064

(22) Filed: Aug. 16, 2017

(65) Prior Publication Data

US 2017/0345232 A1 Nov. 30, 2017

Related U.S. Application Data

(63) Continuation of application No. 14/203,927, filed on Mar. 11, 2014, which is a continuation-in-part of application No. 13/830,807, filed on Mar. 14, 2013.

(60) Provisional application No. 61/610,975, filed on Mar. 14, 2012, provisional application No. 61/793,071, filed on Mar. 15, 2013.

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01)

(58) Field of Classification Search
CPC ..... G08G 1/12; G07C 5/085; G07C 5/008
USPC ..... 701/33.4
See application file for complete search history.

(56) References Cited

U.S. PATENT DOCUMENTS 6,064,970 A * 5/2000 McMillan ..... G06Q 30/0283 705/4
6,438,472 B1 8/2002 Tano
6,445,985 B1 9/2002 Bitzer
8,542,108 B1 9/2013 Izdepski
2002/0167519 A1 11/2002 Olsen
2005/0083404 A1* 4/2005 Pierce ..... B60R 11/02 348/148
2008/0086266 A1 4/2008 Howard
2008/0252487 A1 10/2008 McClellan
2008/0255723 A1 10/2008 Sano
2009/0082919 A1* 3/2009 Hershey ..... F02D 41/249 701/33.4
2009/0171528 A1 7/2009 Golde
2010/0023207 A1 1/2010 Maeda
2013/0245880 A1 9/2013 McQuade
2013/0302758 A1* 11/2013 Wright ..... G07C 5/008 434/65
2014/0167954 A1* 6/2014 Johnson ..... H04W 76/10 340/539.11
2014/0195071 A1 7/2014 Hunt et al.

*Primary Examiner* — Imran K Mustafa

(57) ABSTRACT

System and method for enabling predefined events to be used to trigger the collection of vehicle position data. A combination GSM device and GPS device is used to collect vehicle position data and to convey that position data to a remote computing device for review and/or analysis. There is a tradeoff between collecting too much data (cell phone bill is too high) and collecting too little data (value added analytics cannot be achieved without sufficient data). The concepts disclosed herein relate to method and apparatus to enable the data collection/transmission paradigm of such a GSM/GPS to be varied (or triggered) based on the detection of one or more predefined events. This enables data which can contribute to value added analytics to be acquired, without wasting airtime on unimportant data.

6 Claims, 7 Drawing Sheets

EMERGENCY EVENT BASED VEHICLE DATA LOGGING

RELATED APPLICATIONS

This application is a continuation of application Ser. No. 14/203,927 filed on Mar. 11, 2014 which itself is a continuation in part of application Ser. No. 13/830,807 filed on Mar. 14, 2013 and claims benefit of provisional application Ser. No. 61/793,071 filed on Mar. 15, 2013 and Ser. No. 61/610,975 filed on Mar. 14, 2012, the benefit of the filing dates of which are hereby claimed under 35 U.S.C. § 119(e) and 120.

BACKGROUND

As the cost of sensors, processors, communications systems and navigational systems has dropped, operators of commercial and fleet vehicles now have the ability to collect a tremendous amount of data about the vehicles that they operate. The volume of data available is so significant that it would be desirable to provide method and apparatus to facilitate collecting relatively more data during unusual operating conditions, and relatively less data during normal vehicle operation.

SUMMARY

One aspect of the novel concepts presented herein is a system and method for enabling predefined emergency related events to be used to change a vehicle data collection paradigm (or data logging paradigm), such that relatively more vehicle data is collected during an emergency. Such a concept is particularly suitable for law enforcement and emergency vehicles. It should be understood that the term vehicle data encompasses many different types of data that can be collected from the vehicle (or the vehicle's ambient environment. Exemplary types of vehicle data include, but are not limited to, vehicle position data (such as GPS data, noting that systems other the Global Positioning Systems commonly referred to as GPS can be used to acquire position data), vehicle speed data, braking data, engine parameter data (such as coolant temperature, oil temperature and pressure, fuel flow, load, RPMs, etc.), transmission parameter data, tire pressure data, tire temperature data, time, ambient temperature data, ambient pressure data, altitude data, and/or data from accelerometers.

In one exemplary, but not limiting embodiment, vehicle data is collected during normal operation of the vehicle according to a predefined data logging paradigm. If one were to collect all possible vehicle data, that data will likely incur significant storage and/or transmission costs, and under normal operating conditions such large amounts of data may not provide much value. If very little data is collected, storage and/or transmission costs will be negligible, but such sparse data sets will likely provide little opportunity for mining such data for useful information. Thus, the normal predefined data logging paradigm will likely strike a balance between collecting too much data (to reduce data handling costs) and too little data (smaller data sets are less likely to be very useful). One aspect of the concepts disclosed herein is based on collecting additional amounts of vehicle data during an emergency. In at least one exemplary embodiment, the data logging rate is increased whenever item of emergency equipment at the vehicle is activated. Such emergency equipment includes emergency lights, emergency sirens, emergency data links (such as a radio), and/or emergency panic buttons.

In some embodiments, the collected vehicle data is stored at the vehicle for export at a later time, while in other embodiments the collected vehicle data is wirelessly conveyed to a remote computing device during vehicle operation, if the vehicle is in range of a data link (else the data is stored until such a data link is established).

In at least one embodiment, particularly suitable for law enforcement and emergency vehicles, an existing vehicle data that acquisition paradigm is modified when overhead or flashing lights in the law enforcement vehicle or emergency vehicle are activated (and/or a siren is activated), such that vehicle data is collected more frequently when the overhead lights (or siren) are activated. This concept can be extended to changing the data logging paradigm whenever any emergency related input is detected at the vehicle by a processor/controller in charge of the data logging. This will increase the cost of data transmission (as more data will be transferred to the remote computing device via a cell phone or satellite transmission), but more data will be collected during an emergency situation. In addition to collecting GPS data, other vehicle data (such as speed, acceleration, braking, engine parameter data, such data types being exemplary and not limiting) can also be collected with greater frequency when the overhead lights are activated. In at least one related embodiment, at least one type of vehicle performance data is collected each time a GPS data point is collected. It should be understood that the specific frequency of data collection can be selected based on user preference. In at least one embodiment, the data is collected once every second when the overhead or flashing lights are activated, although it should be recognized that such data collection frequency is exemplary, and not limiting. If no wireless data link is available, the data can be stored in a data buffer for transmission at a later time.

In at least some related embodiments, the vehicle data will include position data. In some such embodiments, a combination GSM device and GPS device is used to collect vehicle position data and to convey that position data to a remote computing device for storage, review and/or analysis. As noted above, there is a tradeoff between collecting too much data (transmission costs are relatively high) and collecting too little data (value added analytics cannot be achieved without sufficient data). The concepts disclosed herein relate to method and apparatus to enable the data collection/transmission paradigm of such a GSM/GPS device to be varied (or triggered) based on the detection of one or more predefined events, such as the activation of the emergency equipment discussed above. This enables data which can contribute to value added analytics to be acquired, without wasting airtime on less important data. It should be recognized that the same concepts can be applied where some other cell phone technology is employed, or where satellite data transmission is used in place of or in addition to cell phone data transmission.

One paradigm for collecting and transmitting GPS data using a GSM/GPS device (or a separate GSM device coupled to a GPS, noting that the concepts disclosed herein can also be implemented using other forms of wireless data transfer, including but not limited to satellite) is to collect GPS data at predetermined intervals, or according to some algorithm that changes the vehicle position data collecting paradigm based on changes in vehicle speed or heading (such an algorithm can enable relatively more data to be collected during city driving versus traveling along a straight section of highway with little change in speed or heading). The concepts disclosed herein are based on modifying the frequency with which GPS data is collected and transmitted to a remote server, based on emergency event related inputs received from the vehicle (i.e., not simply a change in speed or heading as in the above described algorithm). In an exemplary embodiment, those emergency event related inputs are acquired from a vehicle data bus, such as a J1939, J1708, and/or CAN bus. In certain embodiments, such emergency event related inputs can be received from an OBD or OBD-II interface. It should be noted that for embodiments in which the vehicle data does not include GPS or position data, that the J1939 bus, J1708 bus, CAN bus, and/or OBD/OBD-II interfaces can be used to acquire non position related vehicle data as well.

In a related embodiment, the GPS (and any vehicle performance data) that is collected with greater frequency when the overhead or emergency lights are activated is stored in the vehicle, but not transmitted wirelessly to a remote computing device (this will reduce or eliminate the additional data transmission expense). Such additional data will be removed from the vehicle (using a flash drive, USB drive, thumb drive, SD card, or other portable memory device) by removing a portable memory device in which the data is stored, or by coupling a vehicle memory with a physical data link (such as a serial data link, a parallel data link, a FireWire data link, a USB data link, noting that such physical data links are exemplary and not limiting), or using a short range wireless data link, generally as discussed above.

In addition to being implemented as a method, the concepts disclosed herein can also be implemented as non-transitory memory medium storing machine instructions, which when executed by a processor implement the method, and by a system for implementing the method.

The concepts disclosed herein can also be implemented as a vehicle data logger. In such a data logger, the basic elements include at least one data input element that acquires vehicle data, a controller or processor that implements a predefined data logging paradigm (and which changes that data logging paradigm in response to an emergency event, generally as discussed above), a memory in which the logged vehicle data can be stored prior to export, and a data link (or a removable memory) to facilitate export of the vehicle data. The data logger is configured to change the data logging paradigm in response to detecting the activation of emergency equipment, such as lights and/or sirens. Those basic elements can be configured in many different ways. For example, the data logger can be a single integrated device, or the basic elements can be distributed among a plurality of different vehicle components or locations. In some embodiments, the memory is used to store other data in addition to the vehicle data disclosed herein (including but not limited to vehicle inspection data, driver hours of service data, and/or navigation data). In some embodiments, the controller implements functions in addition to data logging. In at least one embodiment, the controller is part of a mobile computing device, such as a smart phone or tablet. In at least one embodiment, the controller is hardwired into the vehicle, and implements additional functions during vehicle operations (such as a vehicle ECU). In at least one embodiment, the controller is part of a telematics device that includes a GPS component. In still another embodiment, the controller is part of a cable device that is configured to tap into and extract vehicle data from an existing vehicle data bus. In an exemplary such cable device, a short range wireless data link included in the cable device enables vehicle data to be exported from the cable device.

The concepts disclosed herein can also be implemented as a system including at least one vehicle equipped with the data logger discussed above, and a remote computing device where vehicle data (with or w/o GPS data) from enrolled vehicles can be stored and/or/analyzed after such vehicle data is exported from the vehicle. The system can, and preferentially does, include a plurality of vehicles, each including the data logger component, and some means for conveying the data from the vehicle to the remote computing device (such as a portable memory, a short range wireless data link, and/or a long range wireless data link).

In at least some embodiments where position data is part of the vehicle data, the data link, GPS component, and processor are integrated into a single device (which can be implemented by one or more of a smart phone, a mobile computing device, a mobile telematics device, and a telematics device more or less permanently installed in the vehicle). The processor at the vehicle implements functions generally consistent with the method discussed above, in which the data logging (and in some embodiments, the frequency of data transmission) is increased when emergency lights or sirens are activated at the vehicle (or other emergency equipment, generally as disclosed herein). In general, the remote computing device can be implemented by a computing system employed by an entity operating a fleet of vehicles, as well as a website operated by a third party. Entities that operate vehicle fleets can thus use such computing systems/websites to track and process data relating to their vehicle fleet. It should be recognized that these basic elements can be combined in many different configurations to achieve the exemplary method discussed above. Thus, the details provided herein are intended to be exemplary, and not limiting on the scope of the concepts disclosed herein.

In at least one related embodiment in which the vehicle data includes GPS data, after an item of emergency equipment (such as emergency lights, an emergency siren, an emergency com link or data link, and/or a panic button) at the vehicle has been activated, GPS data collected thereafter is encoded with the identity of the item of equipment that was activated, thereby generated emergency encoded position data.

The above noted methods are preferably implemented by a processor (such as computing device implementing machine instructions to implement the specific functions noted above) or a custom circuit (such as an application specific integrated circuit). The processor or custom circuit is disposed at the vehicle. The processor can be part of a smart phone, a mobile computing device, a data collection device, a vehicle ECU, a GPS tracking device, and/or a telematics device.

The concepts disclosed herein can be used to collect many different permutations and combinations of vehicle data. Exemplary data types that can be collected include an amount of fuel passing through fuel injectors, other fuel use metrics, throttle position data, engine, oil, coolant and/or brake temperatures data, accessory device use (and any parasitic load associated with such use), cruise control use data, transmission gear data, engine load data, inclinometers data, accelerometer data, hard braking data, engine RPM data.

The concepts disclosed herein encompass embodiments involving analyzing the emergency event vehicle data collected during an emergency event. In an exemplary embodiment, such analysis includes displaying a route traversed by a vehicle with emergency equipment activation data overlaid on the route, the emergency equipment activation being determined by data included in the emergency encoded position data.

Another aspect of the concepts disclosed herein relates to reducing data transfer rates when a quality of the cellular or satellite link (i.e., a long range wireless data link) is poor. Such a concept is particularly well suited to embodiments where the vehicle data being logged or collected includes position data, because consumers of vehicle data that includes position data often desire to have such data exported from the vehicle on frequent basis, so that the physical location of fleet vehicles can be tracked in real-time. However, it should be understood that such a concept could be implemented even where position data is not part of the vehicle data.

Long range wireless data links generally are designed to be able to determine when a wireless data link is available, such that data is transmitted only when a wireless data link is available, and if the wireless data link is unavailable, no data transmission is attempted (the data is stored for later transmission, a technique referred to as store forward). However, there are occasions when a wireless data link is available, but is of such poor quality, that data packets are lost in transmission. Consider a telematics system including data collection components at a vehicle (which can include one or more of a GPS sensor and other vehicle performance data sensors, including a data link coupling a vehicle telematics unit to a vehicle data bus and/or vehicle controller, such as an ECU), a long range wireless data link (such as a cellular or satellite data link), and a remote computing device for archiving and/or analyzing data collected from the vehicle. In such a system, when a data packet is conveyed from the vehicle to the remote computing device, the remote computing device can use the long range wireless data link to send a confirmation to the vehicle that the data packet transmission was successful. Such confirmations can be very compact (perhaps a hash of the data packet that was sent), such that the relative cost of transmission of the confirmation is relatively low. When a controller at the vehicle responsible for the data transmission fails to receive such a confirmation (generally such a controller is part of a vehicle telematics unit, although it should be understood that some other controller at the vehicle can be assigned this task), the data packet can be resent. When the wireless data link is available, but of relatively poor quality, packets can be transmitted multiple times before being successfully received, increasing the amount of airtime (or satellite) time being consumed, driving up costs (airtime/satellite time is often billed per byte or megabyte of data transferred, and failed transmissions are still billed).

The concepts disclosed herein address this issue of reducing unsuccessful data transmissions by changing the logic in the controller at the vehicle managing the data transmission. In one embodiment, if two data packets are not successfully transmitted (i.e., confirmations form the remote server/computing device are not received at the vehicle for the transmitted packets) within a first predetermined period of time, a time out (corresponding to a second predetermined period of time) for subsequent data transmissions is imposed. In an exemplary embodiment, the first predetermined period of time period is five minutes, and the second predetermined period of time is ten minutes, although such time periods are exemplary and not limiting. It should be understood that the first and second predetermined periods of time can be equal in length, or different in length. In some embodiments, the first predetermined period of time is longer than the second predetermined period of time. In other embodiments, the first predetermined period of time is shorter than the second predetermined period of time. It should also be understood that the number of failed transmissions that are required to trigger such a time out can be modified as desired; thus the two failed transmissions discussed in this paragraph is intended to be exemplary, and not limiting. The time out can be imposed based on a single failed transmission, or more than two failed transmissions.

In a related embodiment, one or more of the first and second predetermined periods of time can be modified by the controller managing the data transmission. For example, the first predetermined period of time can initially be relatively short, and if the problem of failed data transmissions continues, the duration of the first predetermined period of time can be increased, to further reduce costs associated with failed data transmissions. The duration of the second predetermined period of time can be similarly modified. The durations of the first and second predetermined periods of time can be extended together, or independently of each other. Similarly, the number of failed attempts before a time out is triggered can also be modified. For example, the number of failed attempts can start out at a first value, and that value can be reduced as the problem of failed transmissions continues.

In a related embodiment, the telematics system (which includes a plurality of vehicles having data collection components (each including a GPS or position sensing component), and a remote computing device or server where the data is stored and/or analyzed), learns over time the locations associated with failed data transmissions. Each time a vehicle fails to receive a confirmation that a data packet was transmitted successfully to the remote server, a location associated with the failed transmission is recorded in a memory at the vehicle. When successful connection with the remote computing device is available, that location data is communicated to the remote computing device, which generates of record of locations associated with data transmission failures. Over time, a map of locations where data transmission failures occur will be developed. Those locations can be provided to the data transmission controller at the participating vehicles, so that data transmission is not attempted in those locations. Recognizing that some data transmission failures are random, and not indicative that there is an ongoing problem with data link quality at the location, such a database of locations can give more weight to locations associated with multiple data transmission failures. In one embodiment, a location is not defined as a do not attempt to transmit data from here location until more than one data transmission failure is associated with that location (and in some embodiments, such failed attempts must be from different vehicles, and/or on different dates). It should be understood that the number of times a failed transmission needs to occur at a particular location before that location is added to a set of locations defined as a do not attempt to transmit data from here location can be adjusted to suit user preference. As the set of locations defined as do not attempt to transmit data from here locations changes over time, that set (or additions/deletions from that set) can be sent from the remote computing device to each enrolled vehicle using the wireless data link. Such updating can be part of an existing firmware update schedule, or a dedicated update.

In at least one embodiment, a specific location is not added to the set of do not attempt to transmit data from here locations unless that location is associated with two different transmission failures on two different dates. In at least one embodiment, a specific location is not added to the set of do not attempt to transmit data from here locations unless that location is associated with two different transmission failures from two different vehicles.

With respect to the set of locations defined as do not attempt to transmit data from here locations, it should be understood that a correction factor can be applied to expand the area from which data transmission will not be attempted. For example, assume location A having a specific latitude and longitude is defined as a location from which data transmission should not be attempted. An expansion factor can be applied to that location, such that data transmission will not be attempted when a vehicle is within some predefined distance of that location. For example, the controller or processor at the vehicle tasked with controlling transmission of data packets can be configured to hold for later transmission any data packet normal operations would cause to be transmitted when the vehicle is within 1 kilometer of a location defined as a do not attempt to transmit data from here location. It should be understood that 1 kilometer parameter is exemplary, and other distances (smaller or larger) can also be selected. Whatever distance is selected should take into account the GPS margin of error, such that the selected expansion factor is larger than the margin of error.

In addition to being implemented as a method, the concepts disclosed herein can also be implemented as a memory medium storing machine instructions, which when executed by a processor implement the method, and by a system for implementing the method. In such a system, the basic elements include a remote computing device where vehicle data from enrolled vehicles can be stored/analyzed (which in some embodiments includes GPS data), a vehicle that is to be operated by a vehicle operator, optional data collection components in the vehicle (sensors/controllers for detecting specific predefined parameters), a wireless data link (such as a cellular or satellite based data link), a geographical position tracking unit (such as a GPS tracking device, noting that the transmission error concepts disclosed herein can be used even when the vehicle data does not include GPS data), and a processor at the vehicle for controlling when vehicle data is conveyed from the vehicle to the remote computing device. The system can, and preferentially does, include a plurality of vehicles, each including, the wireless data link, the GPS tracking device (in embodiments where the vehicle data includes location data), and the processor for controlling when GPS data (or other vehicle data) is conveyed from the vehicle to the remote computing device. In at least some embodiments, the data link, GPS component, and processor are integrated into a single device (which can be implemented by one or more of a smart phone, a mobile computing device, a mobile telematics device, and a telematics device more or less permanently installed in the vehicle). The processor at the vehicle implements functions generally consistent with the method discussed above, in which the transmission of GPS data (or vehicle data) is changed (generally reduced or temporarily halted in an exemplary embodiment) when transmission confirmations fail to be received from the remote computing device. In general, the remote computing device can be implemented by a computing system employed by an entity operating a fleet of vehicles, as well as a website operated by a third party. It should be noted that one aspect of the concepts disclosed herein involves the processor at the remote computing device implementing the function of generating and updating a data set of locations from which data transmission should not be attempted, and forwarding that data set to each enrolled vehicle according to a predetermined schedule. Entities that operate vehicle fleets can thus use such computing systems/websites to track and process data relating to their vehicle fleet. It should be recognized that these basic elements can be combined in many different configurations to achieve the exemplary method discussed above. Thus, the details provided herein are intended to be exemplary, and not limiting on the scope of the concepts disclosed herein.

The above noted method is preferably implemented by a processor (such as computing device implementing machine instructions to implement the specific functions noted above) or a custom circuit (such as an application specific integrated circuit). The processor or custom circuit is disposed at the vehicle. The processor can be part of a smart phone, a mobile computing device, a vehicle ECU, a GPS tracking device, or a telematics device.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 7:
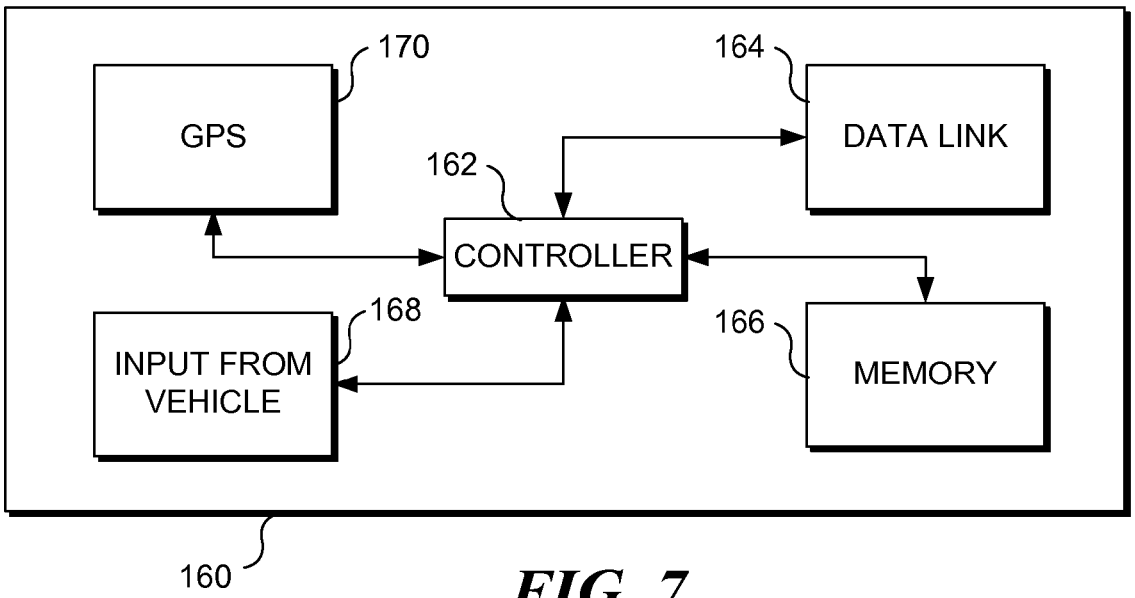
Figure 4:
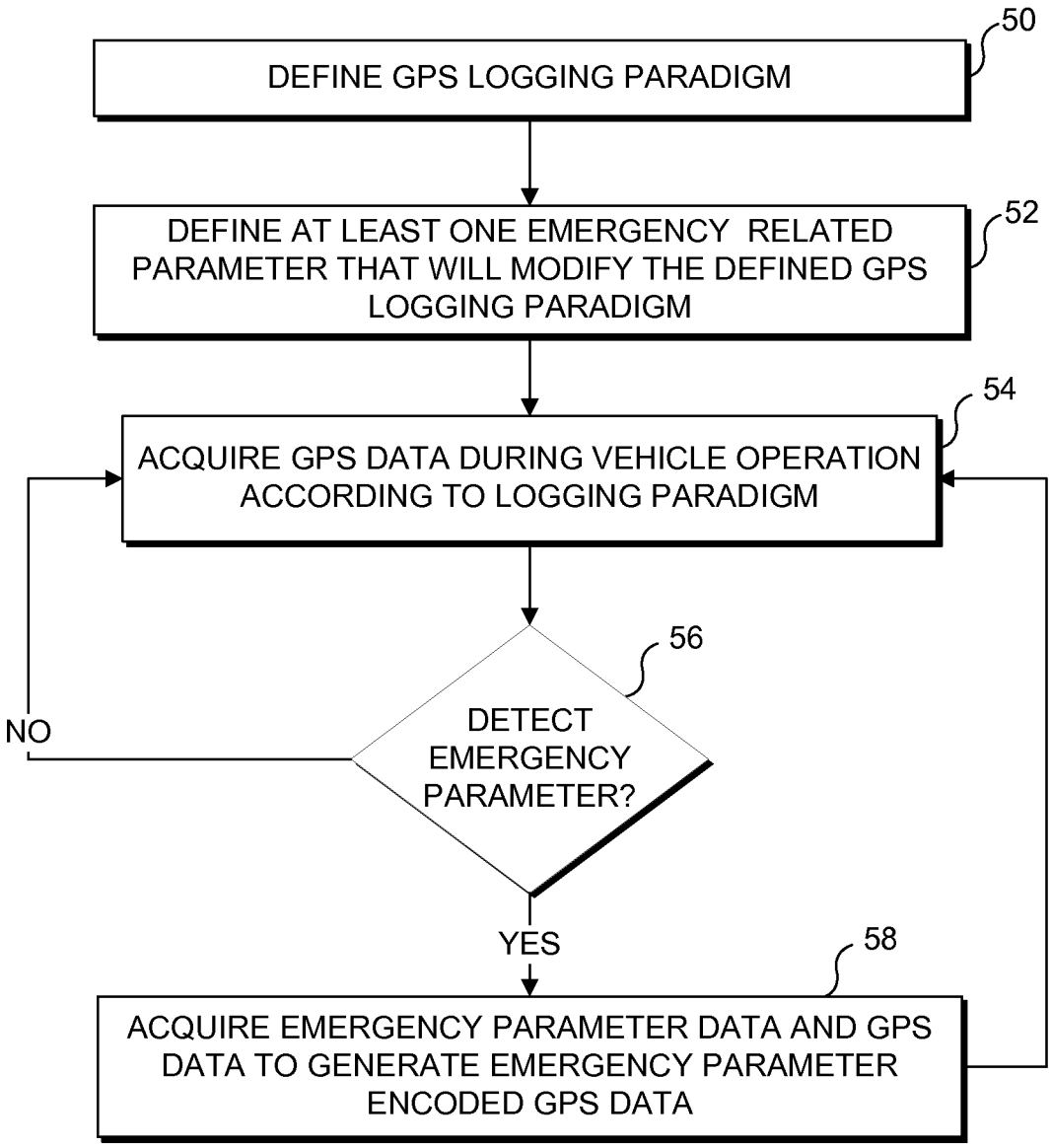
FIG. 4 is a flow chart showing exemplary method steps implemented to modify a GPS logging paradigm based on the detection of one or more emergency related non-position related parameters.
Figure 5A:
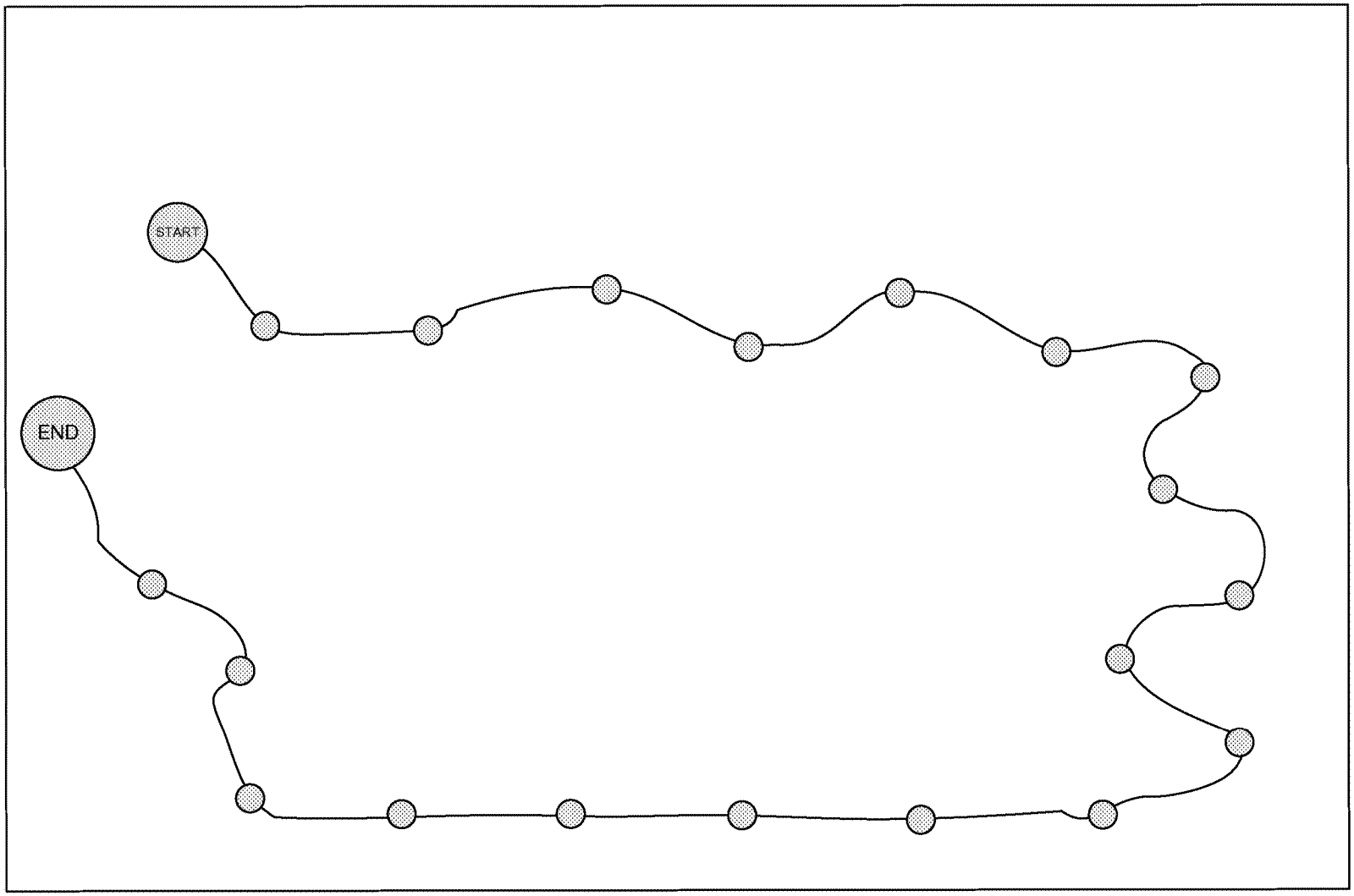
Figure 5B:
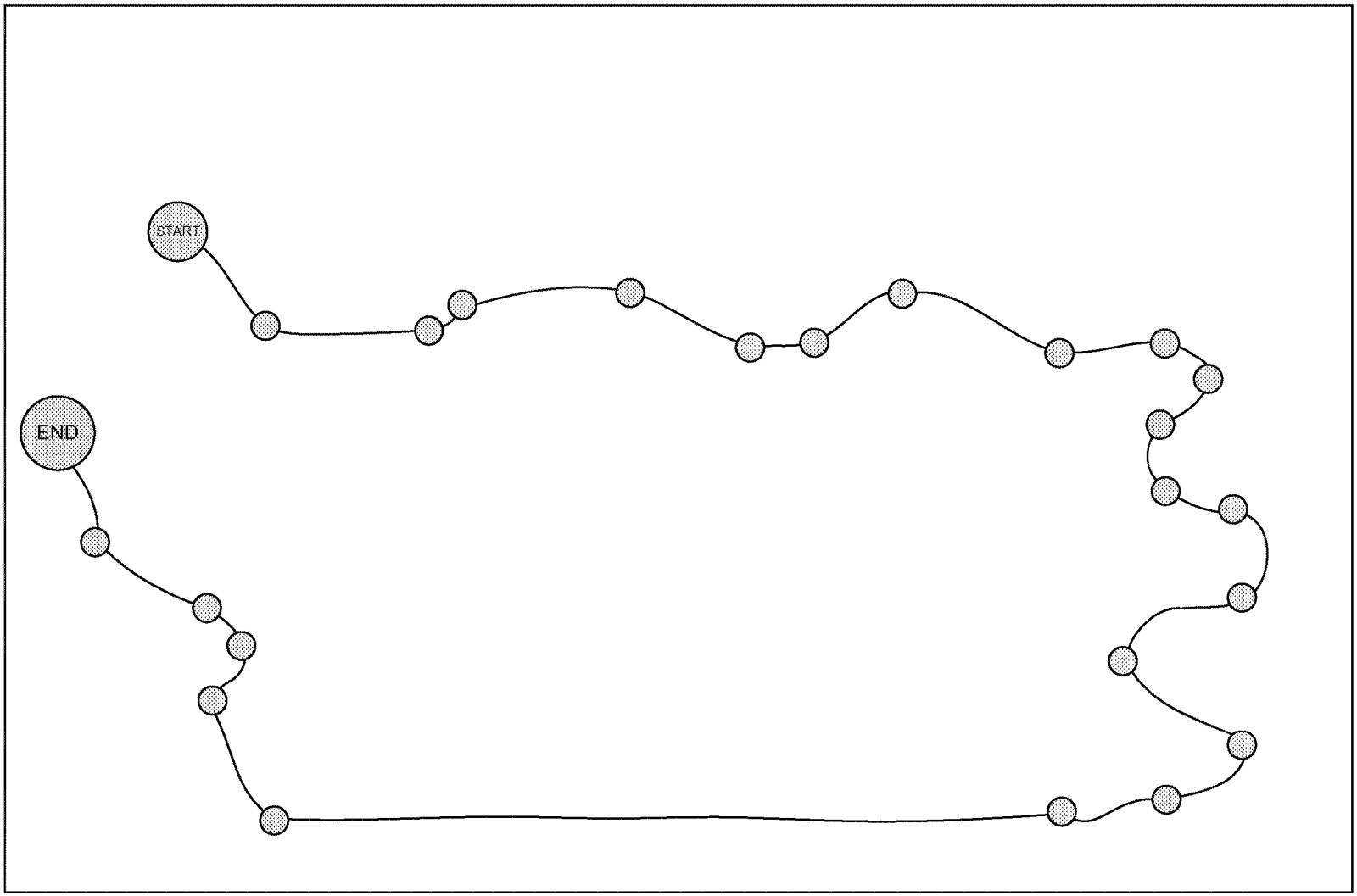
Figure 5C:
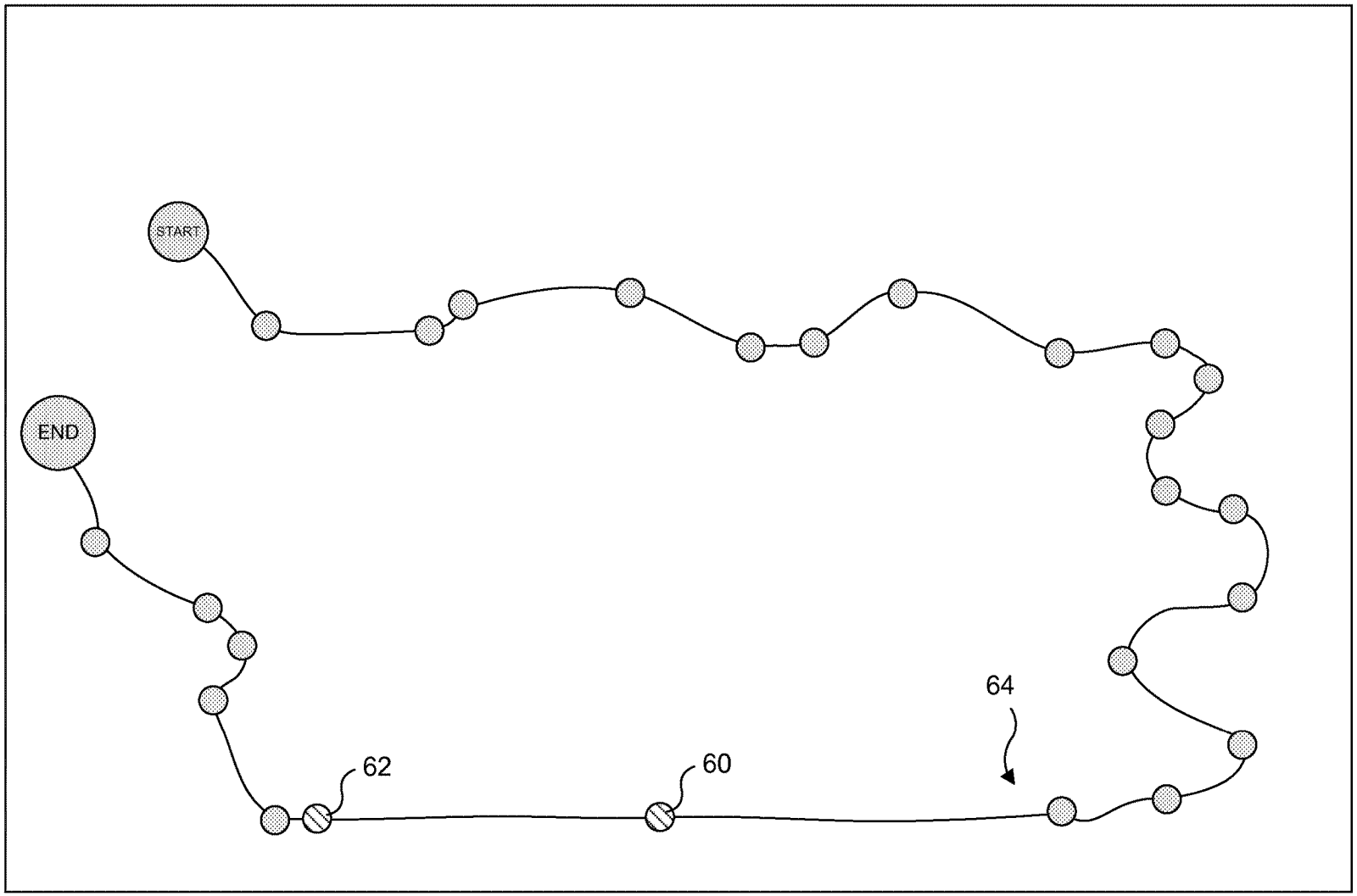
Figure 6:
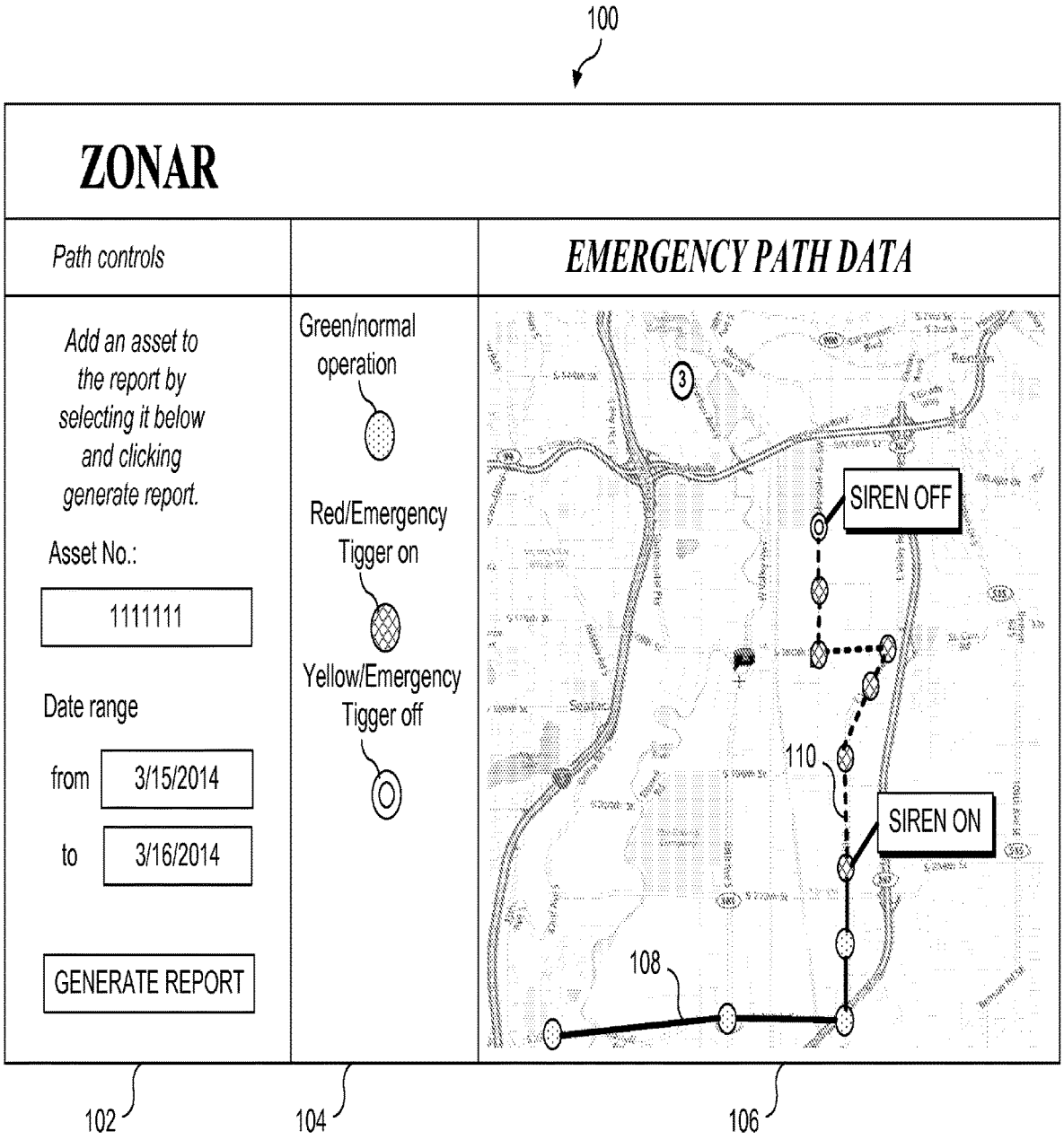

FIG. 5A schematically illustrates a GPS logging paradigm based on GPS logging at predetermined time intervals;

FIG. 5B schematically illustrates a GPS logging paradigm based on GPS logging at predetermined time intervals modified based on position based parameters;

FIG. 5C schematically illustrates the GPS logging paradigm of FIG. 5B modified based on detecting a non-position based parameter, such as an emergency;

FIG. 6 is a screen shot of a web page upon which a vehicle owner can view fuel use data overlaid upon vehicle route data, where the fuel use data was collected using the method of FIG. 4;

FIG. 7 is a functional block diagram of an exemplary telematics device added to an enrolled vehicle to implement one or more of the methods of disclosed herein (i.e., to encode emergency data with GPS data, to increase data logging in response to an emergency condition, and/or to change a data transmission rate based on a quality of a data link).

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive. Further, it should be understood that any feature of one embodiment disclosed herein can be combined with one or more features of any other embodiment that is disclosed, unless otherwise indicated.

As used herein and in the claims that follow, the terms processor and controller have been used interchangeably with respect to describing an element to implement a specific logical function, and applicant intends the terms to be interpreted broadly, as encompassing elements that implement specifically defined logical functions (which in some cases rely on machine instructions stored in a memory to implement the function). Even where the term processor is used in place of the term controller, applicant believes that the artisan of skill would be able to readily determine from the disclosure provide herein what additional elements, such as peripherals (ports, clock, timers, UARTs, and ADC) and memory (including, but not limited to EEPROM, SRAM, EPROM, and flash) will be used in connection with such a processor to implement the described logical function.

Types of Vehicle Data

In some embodiments, the vehicle data includes GPS data, but it should be understood that the concepts disclosed herein can be applied to embodiments in which other types of vehicle data are collected, in addition to or instead of position data. Exemplary types of vehicle data include, but are not limited to, position data, vehicle speed data, braking data, engine parameter data (such as coolant temperature, oil temperature and pressure, fuel flow, load, RPMs, etc.), transmission parameter data, tire pressure data, tire temperature data, time, ambient temperature data, ambient pressure data, altitude data, and/or data from accelerometers and/or other sensors. In some embodiments, the vehicle data is collected from a vehicle ECU or data bus, while in other embodiments some vehicle data is collected from dedicated aftermarket sensors added to the vehicle.

Acquisition of Vehicle Data

The vehicle data can be acquired from tapping into the vehicle data bus via an existing port, or by splicing into the vehicle data bus using generally accepted industry practices. Tapping into a vehicle data bus will allow vehicle data generated by original manufacturer installed sensors, controllers and hardware to be acquired by the vehicle data logger. The data logger can be logically coupled to aftermarket sensors (exemplary, but not limiting types of sensors include temperature sensors, inclinometers, accelerometers, pressure sensors, position sensors) and/or or hardware (exemplary, but not limiting types of hardware include emergency lights, emergency sirens, emergency data links, an operator panic button, lifts, buckets, and arms).

Export of Vehicle Data

The vehicle data can be exported from the vehicle to a remote computing device (or computer network) in multiple ways. In some embodiments, the vehicle data is exported in real-time using a relatively long range wireless data link. The term relatively long range wireless data link encompasses satellite and cellular data transmission. In at least one such embodiment, data is transmitted from the vehicle to a remote computing device using the relatively long range wireless data link during normal vehicle operation. Many different data transmission paradigms can be employed, such as transmitting data at predetermined intervals, transmitting data based on the occurrence of predetermined events, and transmitting data once a certain quantity of data has been collected, including permutations and combinations thereof. Vehicle data can be temporarily stored at the vehicle when the relatively long range wireless data link is unavailable.

In some embodiments, the vehicle data is stored at the vehicle and then exported using a relatively short range wireless data link. The term relatively short range wireless data link encompasses short range radio (such as 900 MHz), Wi-Fi, and IR data transmission. Such relatively short range wireless data links can be employed when a vehicle returns to a fleet storage yard at the end of a day. Such relatively short range wireless data links can also be deployed at a plurality of different locations, so that a vehicle visiting such a location can export stored vehicle data. For example, a fleet operator having a number of facilities (such as a retail store chain having a plurality of stores and/or warehouses) might deploy such short range wireless data links at each of their facilities, such that vehicle data collected by each of the fleet vehicles is exported whenever that vehicle is in range of a company facility. Each facility would include a wireless access point or node, which is used to extract data from the company's fleet vehicles. Once extracted, the data can be sent over a network to a company operated server for archive and analysis (or the data can be conveyed to a third party for archive and analysis). Companies servicing fleet vehicles, such as truck stops, weigh stations, inspection stations, repair stations and/or fueling stations, can deploy such short range wireless data links (i.e., nodes or wireless access points) at each of their facilities, and offer data retrieval and forwarding services to their fleet customers as an additional service (for a fee or for free as an enhancement to their existing service offerings). The amount of data collected, and the size of the memory at the vehicle dedicated to storage of such vehicle data, will determine how frequently such data needs to be exported. Applicants' experience with collecting and exporting vehicle has indicated that very useful data sets can be stored using readily obtainable data storage devices. For example, where data will be exported regularly (at least weekly), 128 MB to 256 MB flash memory can be used. Vehicle data can be accumulated over longer periods of time using larger memory, which is readily available as flash memory in standard sizes up to 32 GB, with even larger sizes becoming available over time. Data logging logic can be implemented where older data is overwritten first in circumstances where data export is delayed and all memory resources have been consumed. Of course, the quantity of vehicle data being collected will impact the amount of storage required.

In some embodiments, drivers or service personnel will be tasked with regularly exporting the vehicle data to a portable computing device (or a portable memory), so the data can be transferred to a company server/computing device, or a data storage facility hosted by a third party. Such data export from the vehicle can be based on a short range wireless data link, a hard wire data link (requiring the collection device to be coupled to a physical data port at the vehicle), and/or by removing a portable memory module from the vehicle (such as a flash memory module). In at least some embodiments, the vehicle data is extracted using a smart phone or tablet computing device.

Exemplary Data Logger with Computing Environment

Figure 1:
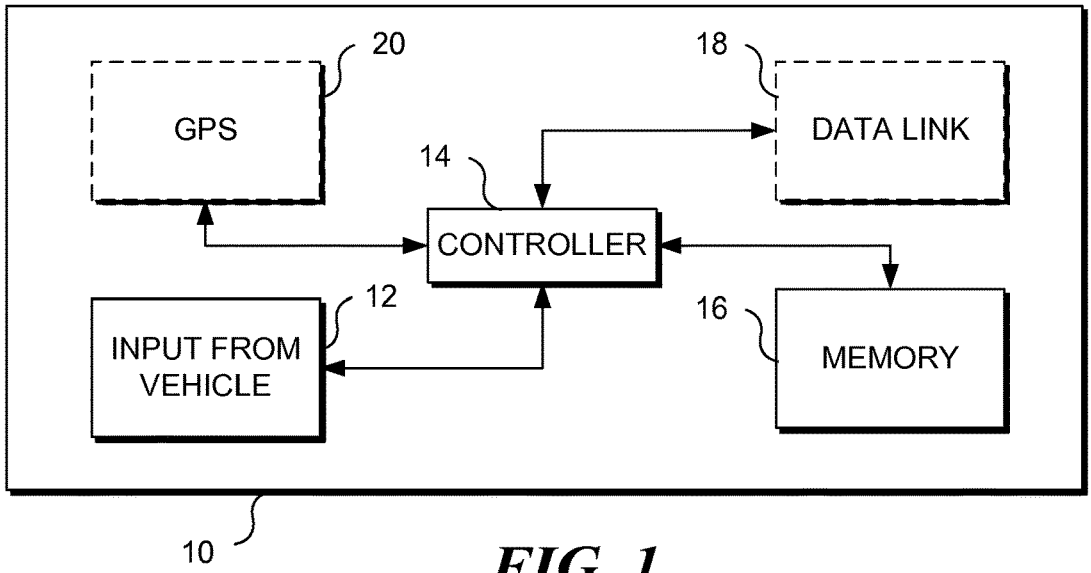
FIG. 1 is a functional block diagram of an exemplary data logger to be used in a vehicle to implement the concepts disclosed herein.

FIG. 1 is a functional block diagram of an exemplary data logger. It should be understood that the basic data logger elements can be configured in many different ways, thus the data logger of FIG. 1 is intended to be exemplary, and not limiting. The basic elements of a data logger 10 in accord with the concepts disclosed herein include at least one data input element 12 that acquires vehicle data, a controller 14 (or processor and additional elements required to enable the processor to implement the required function) that implements a predefined data logging paradigm (and which changes that data logging paradigm in response to an emergency event, generally as disclosed herein and the claims that follow), and a memory 16 in which the logged vehicle data can be stored prior to export. In some embodiments, memory 16 is removable, such that the data can be exported by physically removing the memory. In other embodiments, a data link 18 is provided to facilitate export of the vehicle data. The data link can be a data port to export vehicle data via a hard wire connections, a relatively short range wireless data link (such as short range radio, Wi-Fi, Bluetooth, and/or IR), and/or a relatively long range wireless data link (such as cellular or satellite based).

Significantly, controller 14 implements at least two logical functions. A first logical function is to log (the term log is intended to encompass storing data locally at the vehicle or transmitting data immediately after acquisition to a memory remote from the vehicle) vehicle data according to a predefined data logging paradigm. The concepts disclosed herein can be applied may different types of predefined data logging paradigms. A first a predefined data logging paradigm is based on acquiring vehicle data according to a specific time interval (such as once every minute, one every 5 minutes, once every hour; such time intervals being exemplary). At each time interval, an identical set of vehicle data can be acquired, or the set of vehicle data can be varied at each subsequent interval (such a strategy can be helpful when the amount of vehicle data available is larger than the amount of resources allocated for storage/transmission of the data, in that different types of data can be acquired at different times, thereby increasing a diversity in the data by reducing a density of each different type of data). Certain types of vehicle data (such as position data, for embodiments where position is part of the vehicle data being logged) can be collected at each data logging event, even when other types of data being logged are varied.

A second predefined data logging paradigm is based on acquiring vehicle data based on specific sensor thresholds, such that certain types of vehicle data are logged when a specific threshold value is met. For example, a vehicle might be equipped with one or more of the following sensors: a door sensor, a speed sensor, a cruise control sensor (i.e., an element that can determine whether a cruise control unit is on or off), an engine temperature sensor, tire pressure sensors, brake temperature sensors, an oil temperature sensor, a coolant temperature sensor, an oil pressure sensor, a fault code sensor, and an accessory sensor for accessory equipment such as fans (i.e., an element that can determine whether a specific accessory device is on or off). Note that such sensors are intended to be exemplary, and not limiting. The second predefined data logging paradigm will cause vehicle data to be logged when a defined threshold for a defined sensor is met. For example, the second predefined data logging paradigm can be configured to log vehicle data when a door sensor indicates that a door has been opened. The second predefined data logging paradigm can be configured to log vehicle data when a coolant temperature sensor detects temperatures in excess of 190 degrees F. (noting that such a threshold value is exemplary, and not limiting). Thus, in the second predefined data logging paradigm the vehicle data is logged based not on time, but on events. It should be understood that the first and second predefined data logging paradigms could be combined, so that some vehicle data is logged according to time, while other vehicle data is logged based on an event.

Yet another predefined data logging paradigm (the third predefined data logging paradigm) is based on intelligent logging, which is particularly applicable in embodiments where location data is part of the vehicle data being logged. Intelligent logging delivers fleet management users extremely high fidelity data renderings of vehicle operations in the most cost efficient manner possible. Marked by low data overhead (including transmission and storage) when compared with competing offerings, intelligent logging provides a very efficient data logging paradigm. Instead of collecting GPS location data based on time (the first predefined data logging paradigm discussed above), intelligent logging is a logical method to determine when and where data points should be logged. Although there is a time component to the decision process, intelligent logging primarily uses speed and direction changes to determine when a vehicle location requires logging. Data points are collected whenever starting and stopping a vehicle, as well as whenever speed and direction change. Location and event based collection ensures that relevant data is collected while avoiding unneeded data "overhead". Logged data can be batch processed at the vehicle to reduce data transmission costs associated with cellular or satellite data transmission.

It should be understood that the above described predefined data logging paradigms are intended to be exemplary, as the concepts disclosed herein can be implemented with other predefined data logging paradigms as well. Regardless of what predefined data logging paradigm is implemented during normal vehicle operation (the first function implemented by controller 14), the concepts disclosed herein encompass changing the predefined data logging paradigm (or default data logging paradigm) based on detecting an emergency. The premise is that whatever logic was employed to define a data logging paradigm for normal vehicle operation, having a denser, richer set of vehicle data during an emergency event might have value. Thus, a second function implemented by controller 14 is to increase the data logging (i.e., the sampling rate) during an emergency event. Techniques for determining whether or not an emergency event exists are discussed below.

Referring to the data logger of FIG. 1, it should be recognized that an exemplary data input element will tap into an existing vehicle data bus, which will allow the data logger to acquire vehicle data generated by original manufacturer installed sensors, controllers and hardware. One or more data input elements can be logically coupled to aftermarket sensors (such as temperature sensors, inclinometers, accelerometers, pressure sensors, and/or position sensors). One or more data input elements can be configured to determine the state (such as on or off) of various vehicle hardware elements (such as emergency lights, emergency sirens, emergency data links, an operator panic button, lifts, buckets, and arms).

Exemplary data loggers (each of which include a GPS elements and a cellular data link), consistent with FIG. 1, are available from Zonar Systems of Seattle, Wash., marketed under the names V2J™, WOMBAT™, VTECU™, and V3™. Note earlier versions of such products had similar hardware, but the controller did not implement the specific functions disclosed herein.

Note that in many embodiments, memory 16 will not be removable and a data link will be used to export logged vehicle data. However, the concepts disclosed herein encompass using portable memory modules (such as flash memory devices) so that data can be exported by physically removing a memory module from the vehicle environment. The relative size of the memory will be based on how much data will be accumulated before export intervals. In general, the more frequent the export, the smaller the memory needs to be, while the larger the quantity of data being logged, the larger the memory needs to be.

The data logger is configured to change the data logging paradigm in response to detecting the activation of emergency equipment, such as lights and/or sirens. Those basic elements can be configured in many different ways. For example, the data logger can be a single integrated device, or the basic elements can be distributed among a plurality of different vehicle components or locations. In some embodiments, the memory is used to store other data in addition to the vehicle data disclosed herein (including but not limited to vehicle inspection data, driver hours of service data, and/or navigation data). In some embodiments, the controller implements functions in addition to data logging. In at least one embodiment, the controller is part of a mobile computing device, such as a smart phone or tablet. In at least one embodiment, the controller is hardwired into the vehicle, and implements additional functions during vehicle operations (such as a vehicle ECU). In at least one embodiment, the controller is part of a telematics device that includes a GPS component. In still another embodiment, the controller is part of a cable device that is configured to tap into and extract vehicle data from an existing vehicle data bus. In an exemplary such cable device, a short range wireless data link included in the cable device enables vehicle data to be exported from the cable device.

Figure 2:
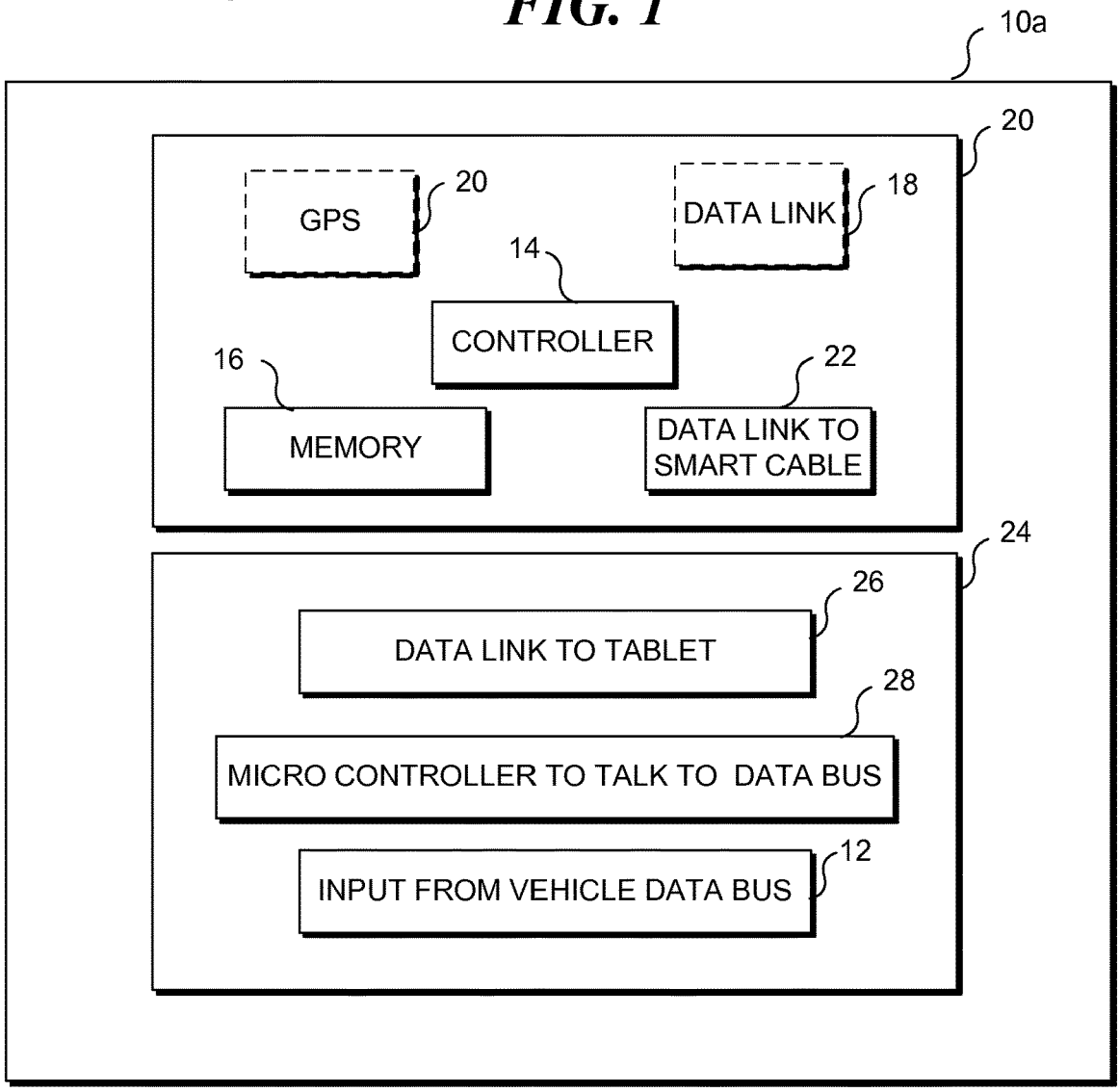
FIG. 2 is a functional block diagram of an exemplary data logger to be used in a vehicle to implement the concepts disclosed herein, which includes a smart cable to access a vehicle data bus, the smart cable being capable of being used in connections with many other concepts, some of which are disclosed herein.

FIG. 2 schematically illustrates an alternative data logger 10*a*, which includes a logger component 20 and a smart cable 24. Logger component 20 is very similar to logger 10, but lacks a data link to the vehicle data bus. Smart cable 24 performs that function. Smart cable 24, also referred to as a JBus cable, performs the function of enabling a data logger (or a GPS unit, or a mobile computing device, or a smart phone, or a telematics device) to establish a logical communication with a vehicle data bus, to enable extraction of data resident or available on the vehicle data bus (or from a vehicle ECU). Smart cable 24 includes a data link to a tablet 24 (or other mobile computing device, including but not limited to logger 20, a smart phone, a GPs unit, a telematics device), a micro controller 28 configured to logically communicate to a vehicle ECU or vehicle data bus, and a connector/input configured to physically connect to a vehicle databus or vehicle ECU.

In at least some embodiment, smart cable 24 includes a wireless data link component (such as Wi-Fi, Bluetooth, or RF), that enables the smart cable to export data from a vehicle data bus/vehicle ECU to a mobile computing device. It should be understood that the potential uses of smart cable 24 extend well beyond the emergency data logging concepts emphasized herein.

In one related embodiment, smart cable 24 is used to enable smart phone uses to extract vehicle fault code data to their smart phones. In at least one embodiment, a party selling the smart cable charges a fee for each use of the smart cable to access data from the vehicle data bus. Besides fault code data, other data include, but are not limited to, throttle position data, fuel use data, and all other data available via the vehicle data bus/ECU.

In another related embodiment, smart cable 24 is used in connection with a fuel authorization system, such as disclosed in commonly owned patent titled METHOD AND APPARATUS FOR FUEL ISLAND AUTHORIZATION FOR THE TRUCKING INDUSTRY, Ser. No. 12/906,615, the disclosure and drawings of which are hereby specifically incorporated by reference. In such an embodiment, smart cable 24 is used to extract a VIN or ZID that is used in the fuel authorization process, generally as described in the reference patent.

Figure 3:
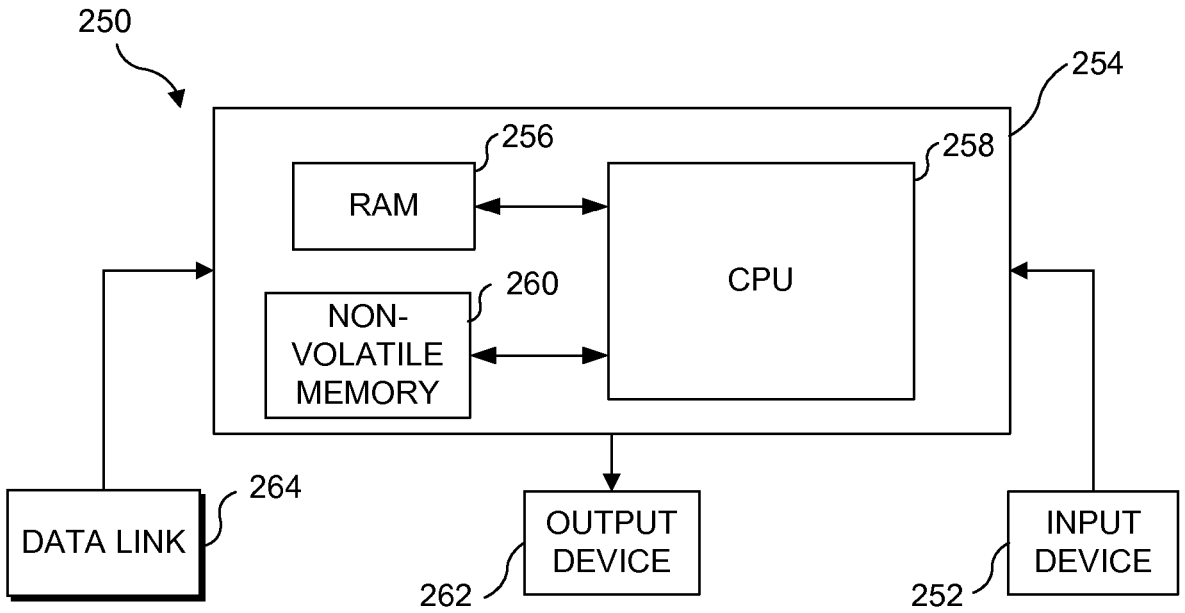
FIG. 3 is a functional block diagram of an exemplary computing device that can be employed to review emergency use encoded position data.

In general, analysis of the emergency encoded position data will be carried out by a remote computing device. The remote computing device in at least one embodiment comprises a computing system controlled or accessed by the fleet operator. The remote computing device can be operating in a networked environment, and in some cases, may be operated by a third party under contract with the fleet operator to perform such services. FIG. 3 schematically illustrates an exemplary computing system 250 suitable for analyzing emergency encoded position data. Exemplary computing system 250 includes a processing unit 254 that is functionally coupled to an input device 252 and to an output device 262, e.g., a display (which can be used to output a result to a user, although such a result can also be stored). Processing unit 254 comprises, for example, a central processing unit (CPU) 258 that executes machine instructions for carrying out an analysis of emergency use encoded position data collected in connection with operation of the vehicle to determine at least one operating characteristic of the vehicle. CPUs suitable for this purpose are available, for example, from Intel Corporation, AMD Corporation, Motorola Corporation, and other sources, as will be well known to those of ordinary skill in this art.

Also included in processing unit 254 are a random access memory (RAM) 256 and non-volatile memory 260, which can include read only memory (ROM) and may include some form of memory storage, such as a hard drive, optical disk (and drive), etc. These memory devices are bi-directionally coupled to CPU 258. Such storage devices are well known in the art. Machine instructions and data are temporarily loaded into RAM 256 from non-volatile memory 260. Also stored in the non-volatile memory are an operating system software and ancillary software. While not separately shown, it will be understood that a generally conventional power supply will be included to provide electrical power at voltage and current levels appropriate to energize computing system 250.

Input device 252 can be any device or mechanism that facilitates user input into the operating environment, including, but not limited to, one or more of a mouse or other pointing device, a keyboard, a microphone, a modem, or other input device. In general, the input device will be used to initially configure computing system 250, to achieve the desired processing (i.e., to compare subsequently collected actual route data with optimal route data, to identify any deviations and/or efficiency improvements). Configuration of computing system 250 to achieve the desired processing includes the steps of loading appropriate processing software into non-volatile memory 260, and launching the processing application (e.g., loading the processing software into RAM 256 for execution by the CPU) so that the processing application is ready for use. Output device 262 generally includes any device that produces output information, but will most typically comprise a monitor or computer display designed for human visual perception of output. Use of a conventional computer keyboard for input device 252 and a computer display for output device 262 should be considered as exemplary, rather than as limiting on the scope of this system. Data link 264 is configured to enable data collected in connection with operation of a vehicle to be input into computing system 250 for subsequent analysis.

Those of ordinary skill in the art will readily recognize that many types of data links can be implemented, including, but not limited to, universal serial bus (USB) ports, parallel ports, serial ports, inputs configured to couple with portable memory storage devices, FireWire ports, infrared data ports, wireless data communication such as Wi-Fi and Bluetooth™, network connections via Ethernet ports, and other connections that employ the Internet.

It should be understood that the term remote computer and the term remote computing device are intended to encompass networked computers, including servers and clients, in private networks or as part of the Internet. The fuel use encoded data can be stored by one element in such a network, retrieved for review by another element in the network, and analyzed by yet another element in the network. In at least one embodiment, a vendor is responsible for storing the data, and clients of the vendor are able to access and manipulate the data. While implementation of the method noted above has been discussed in terms of execution of machine instructions by a processor (i.e., the computing device implementing machine instructions to implement the specific functions noted above), the method could also be implemented using a custom circuit (such as an application specific integrated circuit).

Modifying GPS and Data Logging Based on the Detection of Emergency Condition

As noted above the concepts disclosed herein are directed to changing GPS data collection frequency for law enforcement and emergency vehicles. In such an embodiment, an existing GPS data acquisition paradigm is modified when overhead or flashing lights in the law enforcement vehicle or emergency vehicle is activated (and/or a siren), such that GPS data is collected more frequently when the overhead lights (or siren) are activated. As discussed above, this will increase the cost of data transmission (as more data will be transferred to the remote computing device via a cell phone or satellite transmission), but more data will be collected during an emergency situation, and such data is likely to have more value than data collected during normal operations. Such an embodiment can be directed to only collecting GPS data with greater frequency, as well as to embodiments in which other vehicle data (such as speed, acceleration, braking, engine parameter data, such data types being exemplary and not limiting) can also be collected with greater frequency when the overhead lights/sirens are activated. It should be understood that the change in data logging can be in response to one or more of the activation of a siren (data logging increases), the deactivation of a siren (data logging decreases or returns to normal), the activation of emergency or overhead lights (data logging increases), the deactivation of emergency or overhead lights (data logging decreases or returns to normal), the activation of a panic or alert button (data logging increases), the deactivation of a panic or alert button (data logging decreases or returns to normal), the activation of an emergency broadcast channel or data link in the vehicle (data logging increases), and/or the deactivation of an emergency broadcast channel or data link in the vehicle (data logging decreases or returns to normal).

In such an embodiment, the trigger for the change in data logging (the siren, the lights, the panic button, etc.) will need to be logically connected to the controller in charge of data logging, so that a change in the data logging paradigm can be implemented.

In at least one related embodiment, the change in data logging simply includes collecting position data more (or less) frequently. The concepts disclosed herein can also be implemented to collect additional types of data more (or less) frequently. Such additional types of data can include data from vehicle sensors and ECUs, and includes (but is not limited) to data related to speed, braking, acceleration, load, temperature, fault codes, and fuel use. The concepts disclosed herein also encompass embodiments in which different types of such additional data are collected at different times, to reduce an overall amount of data logged. For example, during the increased data logging, at a first data logging point GPS data and speed data (or a data set including speed data and some other data) might be collected. At a second data logging point GPS data and temperature data (or a different data set including temperature data and some other data) might be collected. This technique would enable a variety of different data types to be collected, while somewhat reducing the quantity of data being collected during enhanced data logging.

It should be understood that the specific frequency of enhanced data collection can be selected based on user preference. In at least one embodiment, the data is collected once every second when the overhead or flashing lights are activated, although it should be recognized that such a one second collection frequency is exemplary, and not limiting. If no wireless data link is available, the data can be stored in a data buffer for transmission to a remote computing device at a later time. Indeed, the concepts disclosed herein encompass embodiments in which rather than using a wireless data link to transmit the enhanced data logging to a remote computing device in real-time, the additional data is stored in a memory in the vehicle, for later retrieval. The increased amount of data being collected during an emergency will likely be used to review details of the emergency after the fact, such that there may be little urgency in making the data immediately available at the remote computing device. If the additional data collected during the emergency (note that enhanced data logging might also be triggered during a non-emergency using a user actuated trigger/input, which can be used to collect additional data when a vehicle operator believes such additional data might be useful, such as when the vehicle is experiencing a malfunction) is stored in a memory at the vehicle, the data will need to be retrieved from the memory at some point. The concepts disclosed herein encompass retrieving the additional data stored in the memory in any of the following ways: (1) by removing a portable memory device in which the additional data is stored from the vehicle when the vehicle returns home; (2) by coupling the memory device in which the additional data is stored to a physical data link when the vehicle returns home; and (3) by wirelessly transmitting the additional data via short range radio vehicle when the vehicle returns home (this requires the vehicle and the home base of the vehicle to be equipped with a short range radio transmitter).

The following figures and text refer to modifying a GPS logging paradigm based on the detection of a non-position related parameter. It should be understood that in the context of the subject matter disclosed and claimed herein the detection of a non-position related parameter is the detection of one or more of the emergency conditions discussed in detail above, rather than some non-emergency related condition noted below.

FIG. 4 is a flow chart showing exemplary method steps implemented to modify a GPS logging paradigm based on the detection of one or more non-position related parameters. In a block 50 a GPS logging paradigm is defined. In general, such logging paradigms attempt to balance collecting a useful amount of GPS data with minimizing airtime consumption. GPS logging paradigms can be based on time, such that GPS data is collected at predetermined time intervals (such as once a minute, once an hour, or once a day, such intervals being exemplary and not limiting). GPS logging paradigms can include collecting additional GPS data upon vehicle start up (i.e., key on) and/or shut down (i.e., key off). GPS logging paradigms can be based in part on collecting GPS data according to predetermine time intervals, combined with collecting additional GPS data when the vehicle changes speed or heading. Once collected, the GPS data is generally conveyed to a remote computing device using a wireless data link, such as a GSM data link or a satellite data link, noting that such data links are exemplary and not limiting. GPS data can be stored until such a link becomes available. GPS data could also be stored at the vehicle for a period of time and later conveyed to an external computing device using wireless or hard wired connections. Such a technique will require relatively more data storage, and memory failures in the vehicle can result in loss of data. Many users find regularly data transfer via cellular or satellite to be more convenient.

Referring to FIG. 4, at least one non-position based parameter (in addition to key on/key off) is identified in a block 52 to be used to modify the selected GPS logging paradigm. The concepts disclosed herein specifically encompass using one or more of the following parameters to change the GPS logging paradigm: fuel use, brake temperature, oil temperature, coolant temperature, throttle position, engine load, engine RPM, shift position/gear selected, cruise control status, and/or accessory device status.

In a block 54 GPS data is acquired during vehicle operation according to the selected GPS logging paradigm. In a decision block 56 a determination is made as to whether one of the parameters selected in block 52 has been detected. If not, the logic returns to block 54. If one of the non-position based (nor key on/key off) parameters is detected in block 56, then the logic moves to a block 58 and parameter encoded GPS data is acquired (i.e., the parameter data and current GPS data are logged, so that a later analysis can correlate the parameter data to the GPS data).

FIG. 5A schematically illustrates a GPS logging paradigm based on GPS logging at predetermined time intervals. The line between the start and end labels represents a vehicle route. Each shaded circle represents a GPS data logging event. The different GPS logging events are relatively equally spaced, indicating the vehicle was traveling at a relatively constant speed during the route. This is but one possibly type of a GPS logging paradigm that can be defined in block 50 of FIG. 4.

FIG. 5B schematically illustrates a GPS logging paradigm based on GPS logging at predetermined time intervals, modified based on position based parameters. Rather than logging GPS data according to elapsed time, the GPS data in this paradigm is logged when the vehicle changes speed or direction. Significantly, note the relative dearth of GPS logging in the lower portion of the route, where the vehicle is not making any changes in direction. Such a route can correspond to a relatively straight section of highway. Along such a route segment, where there is no change in speed or heading, there is little need to collect GPS data, and eliminating some GPS logging events will reduce a quantity of airtime consumed.

FIG. 5C schematically illustrates the GPS logging paradigm of FIG. 5B modified based on detecting a non-position based parameter. In this case, the non-position based parameter is turning some emergency related equipment, such as a siren, on and off. The emergency related equipment was turned on at a location 60, and was turned off at a location 62. The GPS logging paradigm was modified at locations 60 and 62, and the status of the emergency related equipment was recorded at those locations, as well as the GPS coordinates. When an operator of the vehicle reviews the route data, a better understanding of the relationship between the location and the emergency can be obtained.

FIG. 6 is a screen shot of a web page upon which a vehicle owner can view emergency related data overlaid upon vehicle route data, where the emergency related data was collected using the method of FIG. 4. In addition to logging GPS data according to a predefined GPS logging paradigm based, GPS data was also collected when use of emergency equipment is activated. It should be recognized that FIG. 6 makes reference to fuel use rather than emergency equipment use, but the concepts of displaying the specific condition (fuel use verses emergency use), is fundamentally the same). The combination of emergency use data and GPS data, presented to a user in the format shown in FIG. 6, enables vehicle operators (such as fleet managers) to quickly review contextual geographical information related to the emergency.

Another aspect of the concepts disclosed herein relates to reducing data transfer rates when a quality of the cellular or satellite link is poor. Wireless data links generally are designed to be able to determine when a wireless data link is available, such that data is transmitted only when a wireless data link is available, and if the wireless data link is unavailable not data transmission is attempted (the data is stored for later transmission, a technique referred to as store forward). However, there are occasions when a wireless data link is available, but is of such poor quality, that data packets are lost in transmission. Consider a telematics system including data collection components at a vehicle (which can include one or more of a GPS sensor and other vehicle performance data sensors, including a data link coupling a vehicle telematics unit to a vehicle data bus and/or vehicle controller, such as an ECU), a wireless data link (such as a cellular or satellite data link), and a remote computing device for archiving and analyzing data collected from the vehicle. In such a system, when a data packet is conveyed from the vehicle to the remote computing device, the remote computing device can use the wireless data link to send a confirmation to the vehicle that the data packet transmission was successful. Such confirmations can be very compact (perhaps a hash of the data packet that was sent), such that the relative cost of transmission of the confirmation is relatively low. When a controller at the vehicle responsible for the data transmission fails to receive such a confirmation (generally such a controller is part of a vehicle telematics unit, although it should be understood that some other controller at the vehicle can be assigned this task), the data packet can be resent. When the wireless data link is available, but of relatively poor quality, packets can be transmitted multiple times before being successfully received, increasing the amount of airtime (or satellite) time being consumed, driving up costs (airtime/satellite time is often billed per byte or megabyte of data transferred, and failed transmissions are still billed).

The concepts disclosed herein address this issue of reducing unsuccessful data transmissions by changing the logic in the controller at the vehicle managing the data transmission. In one embodiment, if two data packets are not successfully transmitted (i.e., confirmations form the remote server/computing device are not received at the vehicle for the transmitted packets) within a first predetermined period of time, a time out (corresponding to a second predetermined period of time) for subsequent data transmissions is imposed. In an exemplary embodiment, the first predetermined period of time period is five minutes, and the second predetermined period of time is ten minutes, although such time periods are exemplary and not limiting. It should be understood that the first and second predetermined periods of time can be equal in length, or different in length. In some embodiments, the first predetermined period of time is longer than the second predetermined period of time. In other embodiments, the first predetermined period of time is shorter than the second predetermined period of time. It should also be understood that the number of failed transmissions that are required to trigger such a time amount can be modified as desired; thus the two failed transmissions discussed in this paragraph is intended to be exemplary, and not limiting. The time out can be imposed based on a single failed transmission, or more than two failed transmissions.

In a related embodiment, one or more of the first and second predetermined periods of time can be modified by the controller managing the data transmission. For example, the first predetermined period of time can initially be relatively short, and if the problem of failed data transmissions continues, the duration of the first predetermined period of time can be increased, to further reduce costs associated with failed data transmissions. The duration of the second predetermined period of time can be similarly modified. The durations of the first and second predetermined periods of time can be extended together, or independently of each other. Similarly, the number of failed attempts before a time out is triggered can also be modified. For example, the number of failed attempts can start out at a first value, and that value can be reduced as the problem of failed transmissions continues.

In a related embodiment, the telematics system (which includes a plurality of vehicles having data collection components (including a GPS or position sensing component), and a remote computing device or server where the data is stored and/or analyzed), learns over time the locations associated with failed data transmissions. Each time a vehicle fails to receive a confirmation that a data packet was transmitted successfully, a location associated with the failed transmission is recorded in a memory at the vehicle. When successful connection with the remote computing device is available, that location data is communicated to the remote computing device, which generates of record of locations associated with data transmission failures. Over time, a map of locations where data transmission failures occur will be developed. Those locations can be provided to the data transmission controller at the participating vehicles, so that data transmission is not attempted in those locations. Recognizing that some data transmission failures are random, and not indicative that there is an ongoing problem with data link quality at the location, such a database of locations can give more weight to locations associated with multiple data transmission failures. In one embodiment, a location is not defined as a do not attempt to transmit data from here location until more than one data transmission failures are associated with that location. It should be understood that the number of times a failed transmission need to occur at a particular location before being added to a set of locations defined as a do not attempt to transmit data location from here can be adjusted to suit user preference. As the set of locations defined as a do not attempt to transmit data from here changes over time, that set (or additions/deletions from that set) can be sent from the remote computing device to each enrolled vehicle using the wireless data link. Such updating can be part of an existing firmware update schedule, or a dedicated update.

With respect to the set of locations defined as a do not attempt to transmit data from here, it should be understood that a correction factor can be applied to expand the area from which data transmission will not be attempted. For example, assume location A is defined as a location from which a data transmission should not be attempted. An expansion factor can be applied to that location, such that data transmission will not be attempted when a vehicle is within some predefined distance of that location. For example, the controller or processor at the vehicle tasked with controlling transmission of data packets can be configured to hold for later transmission any data packet normal operations would cause to be transmitted when the vehicle is within 1 kilometer of a location defined as a do not attempt to transmit data from here. It should be understood that 1 kilometer is exemplary, and other distances can also be selected. Whatever distance is selected should take into account the GPS margin of error, such that the selected expansion factor is larger than the margin of error.

Non-Transitory Memory Medium

Many of the concepts disclosed herein are implemented using a processor that executes a sequence of logical steps using machine instructions stored on a physical or non-transitory memory medium. It should be understood that where the specification and claims of this document refer to a memory medium, that reference is intended to be directed to a non-transitory memory medium. Such sequences can also be implemented by physical logical electrical circuits specifically configured to implement those logical steps (such circuits encompass application specific integrated circuits).

Exemplary GPS Device with Onboard Computing Environment

FIG. 7 is a functional block diagram of an exemplary telematics device added to an enrolled vehicle to implement one or more of the methods of disclosed herein (i.e., to encode emergency data with GPS data, to increase data logging in response to an emergency condition, and/or to change a data transmission rate based on a quality of a data link).

An exemplary telematics unit 160 includes a controller 162, a wireless data link component 164, a memory 166 in which data and machine instructions used by controller 162 are stored (again, it will be understood that a hardware rather than software-based controller can be implemented, if desired), a position sensing component 170 (such as a GPS receiver), and a data input component 168 configured to extract vehicle data from the vehicle's data bus and/or the vehicle's onboard controller (noting that the single input is exemplary, and not limiting, as additional inputs can be added, and such inputs can be bi-directional to support data output as well).

The capabilities of telematics unit 160 are particularly useful to fleet operators. Telematics unit 160 is configured to collect position data from the vehicle (to enable vehicle owners to track the current location of their vehicles, and where they have been) and to collect vehicle operational data (including but not limited to engine temperature, coolant temperature, engine speed, vehicle speed, brake use, idle time, and fault codes), and to use data link 164 to (wirelessly in an exemplary but not limiting embodiment) convey such data to vehicle owners. These data transmission can occur at regular intervals, in response to a request for data, or in real-time, or be initiated based on parameters related to the vehicle's speed and/or change in location, and/or the change in logging parameters discussed above. The term "real-time" as used herein is not intended to imply the data are transmitted instantaneously, since the data may instead be collected over a relatively short period of time (e.g., over a period of seconds or minutes), and transmitted to the remote computing device on an ongoing or intermittent basis, as opposed to storing the data at the vehicle for an extended period of time (hour or days), and transmitting an extended data set to the remote computing device after the data set has been collected. Data collected by telematics unit 160 can be conveyed to the vehicle owner using data link 164. If desired, additional memory can be included to temporarily store data when the data link cannot transfer data. In particularly preferred embodiments the data link is GSM or cellular technology based.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. In a telematics system for use in a road vehicle, the telematics system being configured to collect and log at least one type of vehicle data during operation of the vehicle, and comprising:

(a) a geographical position sensing component for collecting geographical position data from the road vehicle during vehicle operation, the geographical position data being time indexed;

(b) a memory for storing road vehicle data;

(c) a real time wireless data link;

(d) a processor for implementing the functions of:

(i) collecting and logging vehicle data at a first collecting and logging frequency, according to a predefined data logging paradigm and periodically using the real time wireless data link to send this data to a remote computing device;

(ii) the improvement comprising, in response to the activation of an item of emergency equipment at the vehicle, increasing the amount of vehicle position data collected per unit of time by collecting and logging data at a second collecting and logging frequency that is higher than said first collecting and logging frequency, the item of emergency equipment comprising at least one element from a group consisting of:

(A) an emergency siren;

(B) an emergency light;

(C) an emergency communications data link; and (D) a panic button; and (iii) returning to the predefined data logging paradigm to collect vehicle data at said first collecting and logging frequency, once the item of emergency equipment is deactivated;

wherein the processor further implements the function of returning to the defined logging paradigm to collect data at said first collecting and logging frequency after at least one of the following events:

(a) the vehicle remains motionless for more than a predetermined period of time;

(b) a predetermined period of time elapses;

(c) the vehicle arrives at a location corresponding to a fleet vehicle storage yard; and (d) the vehicle arrives at a location corresponding to an emergency location.

2. The system of claim 1, wherein the processor further implements the function of combining data defining the item of emergency equipment that was activated and the geographical position data together at the vehicle to produce emergency encoded position data.

3. The system of claim 1, wherein the data link comprises a relatively short-range wireless data link.

4. The system of claim 1, wherein the data link comprises a relatively long-range wireless data link.

5. In a non-transitory memory medium having machine instructions stored thereon for controlling the automatic collection and logging of vehicle geographical position data during the operation of a vehicle, the machine instructions, when implemented by a processor, carrying out the functions of:

(a) collecting and logging vehicle geographical position data at a first collecting logging and frequency according to a predefined data logging paradigm and sending the geographical position data over a wireless data link to a remote computing device;

(b) the improvement comprising in response to the activation of an item of emergency equipment at the vehicle, increasing the amount of vehicle data collected per unit time by collecting and logging geographical position data at a second collecting and logging frequency that is higher than said first collecting and logging frequency, the item of emergency equipment comprising at least one element from a group consisting of:

(i) an emergency siren;

(ii) an emergency light;

(iii) an emergency communications data link; and (iv) a panic button;

(c) returning to the predefined data logging paradigm to collect vehicle data at said first collecting and logging frequency, once the item of emergency equipment is deactivated;

wherein the machine instructions, when implemented by the processor, further carry out the function of returning to the defined logging paradigm to collect and log data at said first collecting and logging frequency after at least one of the following events:

(a) the vehicle remains motionless for more than a predetermined period of time;

(b) a predetermined period of time elapses;

(c) the vehicle arrives at a location corresponding to a fleet vehicle storage yard; and (d) the vehicle arrives at a location corresponding to an emergency location.

6. The non-transitory memory medium of claim 5, wherein the machine instructions, when implemented by the processor, further carry out the function of combining data defining the item of emergency equipment that was activated and geographical position data together at the vehicle to produce emergency encoded position data.

* * * * *